US008333035B2

(12) United States Patent
Nabetani et al.

(10) Patent No.: US 8,333,035 B2
(45) Date of Patent: Dec. 18, 2012

(54) DOOR ASSEMBLY INCLUDING A SENSOR FOR CONTROLLING AUTOMATED DOOR MOVEMENT

(75) Inventors: Tadaaki Nabetani, Chiba (JP); Jiro Kashima, Chiba (JP); Atsushi Yamada, Chiba (JP)

(73) Assignee: Otis Elevator Company, Farmington, CT (US)

( * ) Notice: Subject to any disclaimer, the term of this patent is extended or adjusted under 35 U.S.C. 154(b) by 616 days.

(21) Appl. No.: 12/439,266

(22) PCT Filed: Sep. 12, 2006

(86) PCT No.: PCT/US2006/035137

§ 371 (c)(1),
(2), (4) Date: Feb. 27, 2009

(87) PCT Pub. No.: WO2008/033118

PCT Pub. Date: Mar. 20, 2008

(65) Prior Publication Data

US 2009/0249697 A1 Oct. 8, 2009

(51) Int. Cl.
*E05F 15/06* (2006.01)

(52) U.S. Cl. ..... 49/26; 49/27; 49/28; 49/116; 49/267

(58) Field of Classification Search ..... 49/26–28, 49/116, 118, 266, 267, 370; 200/61.43; 187/316, 187/317; 318/466–470
See application file for complete search history.

(56) References Cited

U.S. PATENT DOCUMENTS 3,609,914 A * 10/1971 Berl ..... 9/5
4,051,336 A * 9/1977 Miller ..... 200/61.43
4,143,367 A * 3/1979 Schestag ..... 340/540
4,301,621 A * 11/1981 Houweling ..... 49/27
4,894,952 A * 1/1990 Trett et al. ..... 49/25
5,347,755 A * 9/1994 Jaster et al. ..... 49/25

(Continued)

FOREIGN PATENT DOCUMENTS

DE 19937561 A1 2/2001

(Continued)

OTHER PUBLICATIONS

International Search Report and Written Opinion of the International Searching Authority for International application No. PCT/US2006/035137 mailed May 29, 2007.

(Continued)

*Primary Examiner* — Katherine W Mitchell
*Assistant Examiner* — Marcus Menezes
(74) *Attorney, Agent, or Firm* — Carlson, Gaskey & Olds PC

(57) ABSTRACT

An assembly (20) for controlling movement of an automatically moveable door panel (22) includes sensors (30, 50) such as microswitches positioned on at least one of a door panel (22) or a door frame member (26). The sensors provide an indication of different levels of relative movement between the door panel and the door frame member at an interface (28) between them. Such relative movement includes an increase in a gap between them that corresponds to a situation when an object is at the interface (28) and may be caught. The sensors (30, 50) respectively provide an indication of when an object may become caught and when one has. Automated movement of a door is controlled responsive to an indication of the presence of an object in a location where the object may become caught during automatic movement of the door.

11 Claims, 5 Drawing Sheets

U.S. PATENT DOCUMENTS

| | | | | |
|---|---|---|---|---|
| 5,369,912 | A | 12/1994 | Ginzel et al. | |
| 5,886,307 | A * | 3/1999 | Full et al. | 187/317 |
| 5,925,858 | A * | 7/1999 | Full et al. | 187/317 |
| 5,983,567 | A | 11/1999 | Mitsuda | |
| 5,996,281 | A * | 12/1999 | Takano et al. | 49/26 |
| 6,098,341 | A * | 8/2000 | Gebauer | 49/226 |
| 6,225,768 | B1 * | 5/2001 | Cookson et al. | 318/280 |
| 6,278,376 | B1 * | 8/2001 | Calamatas | 340/686.1 |
| 6,304,178 | B1 * | 10/2001 | Hayashida | 340/545.1 |
| 6,483,054 | B2 * | 11/2002 | Suzuki et al. | 200/61.44 |
| 6,525,659 | B2 * | 2/2003 | Jaffe et al. | 340/545.6 |
| 6,547,042 | B1 * | 4/2003 | Collins | 187/317 |
| 6,732,839 | B2 * | 5/2004 | Schuster | 187/391 |
| 6,782,660 | B2 * | 8/2004 | Takada et al. | 49/25 |
| 6,962,239 | B2 * | 11/2005 | Shikai et al. | 187/316 |
| 7,044,271 | B2 * | 5/2006 | De Coi | 187/316 |
| 7,224,136 | B2 * | 5/2007 | Saitou et al. | 318/286 |
| 7,575,101 | B2 * | 8/2009 | Copsey | 187/316 |
| 2002/0124469 | A1 * | 9/2002 | Rogers et al. | 49/360 |
| 2009/0108987 | A1 * | 4/2009 | Shikai et al. | 340/3.1 |
| 2010/0024301 | A1 * | 2/2010 | Wuerstlein et al. | 49/28 |

FOREIGN PATENT DOCUMENTS

| | | |
|---|---|---|
| JP | 07149489 | 6/1995 |
| WO | 0125129 A1 | 4/2001 |

OTHER PUBLICATIONS

International Preliminary Report on Patentability for International application No. PCT/US2006/035137 mailed Dec. 16, 2008.

* cited by examiner

DOOR ASSEMBLY INCLUDING A SENSOR FOR CONTROLLING AUTOMATED DOOR MOVEMENT

FIELD OF THE INVENTION

This invention generally relates to automatically moving doors. More particularly, this invention relates to controlling movement of an automatically moveable door.

DESCRIPTION OF THE RELATED ART

There are various automated door arrangements used in various contexts. In some instances, the automated door slides in a direction parallel to the door panel between open and closed positions. This type of arrangement is commonly used for providing access to an elevator car.

Whenever an automated door moves toward a position where an edge of the door approaches another structural member in a closed position, it is possible for an object to get caught between the door and the other structural member. Various arrangements have been proposed to avoid such a situation.

In the case of elevator doors, it has been known to use a safety shoe that mechanically detects an obstacle near a closed position of a door by including a bar at the leading edge of the door. If an obstacle contacts the bar, that provides an indication that the door should not be fully closed automatically to allow for the obstacle to be removed so that it will not be caught between the door and another surface. Another example approach has been to use light-based detectors that generate a sensing light beam across an opening. If an obstacle is within the opening while a door is automatically closing and interrupts the light beam, the door will not be fully closed automatically to avoid the object being caught by the door.

There are limitations to such devices. For example, the safety shoe bar typically is not sensitive enough to detect relatively small objects such as a strap on a handbag or an individual finger. Additionally, such small objects may get caught if they are not located at the same position as the bar of the safety shoe. The light-based detectors are also limited in that an object may not be within the field of vision (e.g., the light beam) even though the object is in a position where it can be caught by the door. Another drawback to known light-based arrangements is that they are typically exposed to dust or debris that can interfere with proper operation. Another potential issue is presented if other light sources interfere with the detectors.

Another shortcoming of such devices is that they only address the possibility of an object being caught at the leading edge of the door as it moves toward a closed position.

It would be desirable to provide an improved arrangement for detecting when an object may be in a position to be caught by a door that is automatically moving. It would be beneficial to provide an arrangement that can detect the potential for an object being caught when a door is automatically moving toward a closed position, toward an open position or both. This invention addresses those needs.

SUMMARY OF THE INVENTION

An exemplary door assembly includes a door panel that is automatically moveable between open and closed positions. At least one switch is activated responsive to an increase in a gap at an interface between the door panel and another surface that the door panel moves past while the door panel moves between the open and closed positions. A controller controls automatic movement of the door responsive to activation of the switch.

In one example, the switch is supported on the door and is activated responsive to movement of the door panel away from the surface the door moves past. The switch is activated when the door panel moves in a direction generally perpendicular to a direction of movement of the door panel as it moves between the open and closed positions.

One example includes two switches. One switch is activated when a first amount of pressure is applied to the door panel. This switch provides an indication that an object may be in a position where it could become caught at the interface between the door panel and the other surface. Another switch is activated responsive to more pressure on the door panel. This other switch provides an indication that an object has become caught at the interface.

Another example includes a switch supported on a return panel associated with a door frame. In one example, the return panel has at least one portion that flexes or moves responsive to pressure applied by an object approaching or caught in the interface between the door and the return panel.

An exemplary method of automatically controlling movement of the door panel includes determining whether a gap increases at an interface between the door panel and another surface that the door panel moves past as the door panel moves between open and closed positions. If the gap increases, an indication that an object should be moved away from the interface can be provided, automatic movement of the door panel can be at least temporarily prevented, the door panel may be automatically moved in a first direction and then in a second, opposite direction, or a combination of more than one of these may be done responsive to determining that the gap has increased.

The various features and advantages of this invention will become apparent to those skilled in the art from the following detailed description. The drawings that accompany the detailed description can be briefly described as follows.

DETAILED DESCRIPTION OF THE PREFERRED EMBODIMENT

Disclosed examples include a sensor on at least one of a door panel or a door frame that allow for detecting when a gap between the door panel and the door frame is caused by an object being in a position relative to the door panel or door frame where the object may be caught during automatic movement of the door panel relative to the frame. With the example approach, a wider variety of objects may be reliably detected and a larger number of scenarios within which an object may be caught during automatic door movement can be addressed.

Figure 1:
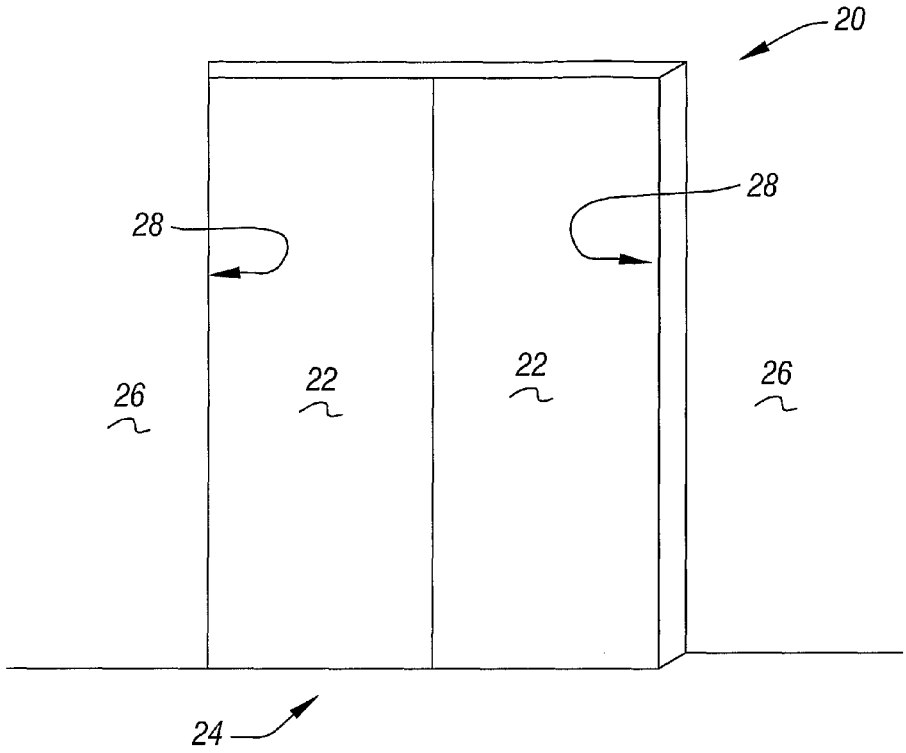
FIG. 1 schematically illustrates an example door assembly.

FIG. 1 schematically shows selected portions of an example door assembly 20. Door panels 22 are automatically moveable between open and closed positions within an opening 24. The example of FIG. 1 shows the door panels 22 in a closed position. In the illustrated example, each door panel 22 moves relative to a return panel 26 as the door panels 22 move between the open and closed positions. The return panel 24 is part of the door frame in this example and is adjacent a pocket for receiving the door panel 22 in the open position.

Figure 2:
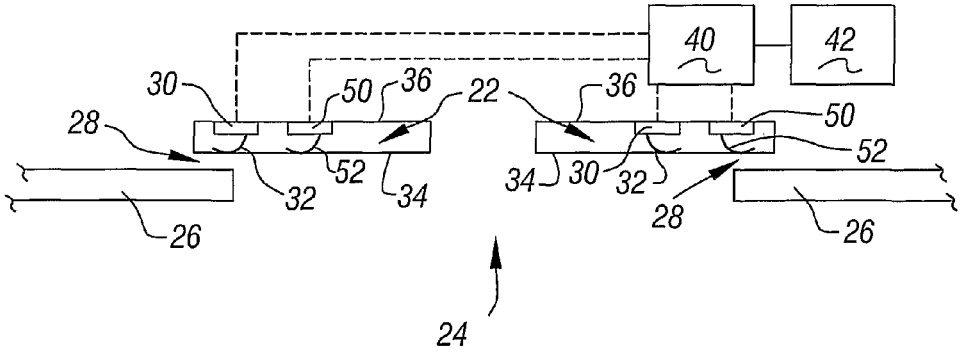
FIG. 2 schematically illustrates one example sensor placement.

FIG. 2 schematically represents an end view of a door assembly as shown in FIG. 1. Such an arrangement may be useful as an elevator door on the elevator car side or the hoistway side, for example. Each of the door panels 22 in this example includes a first switch 30 that is supported on the door panel 22. In this example, the first switch 30 comprises a microswitch that operates in a known manner to provide an electrical output upon switch activation. In this example, an arm 32 of the first switch 30 is positioned relative to a first side 34 of the door panel 22, which faces the interface 28. In the illustrated example, at least a portion of the first switch 30 is physically supported to remain stationary relative to a second surface 36 of the door panel 22.

Whenever pressure is applied on the first surface 34, there will be some flexing or movement of the first surface 34 relative to the second surface 36. In one example, this occurs because of the material used for the first surface 34. A sheet of metal, for example, has some resiliency or flexibility such that it can be deflected toward the second surface 36 when pressure is applied onto the first surface 34 (e.g., from the bottom according to the drawing). The first switch 30 is positioned to detect such pressure on the first surface 34 and the switch arm 32 moves responsive to such pressure-induced movement of the first panel 34.

The switch 30 provides an output indicative of the detected movement of the first surface 34 responsive to an object applying pressure against the first surface 34. The output signal from the switch 30 is provided to a controller 40 that responsively controls automatic movement of the door assembly by controlling a door mover 42. Example control strategies are described below.

In one example, the first switch 30 is configured to provide an indication of an amount of movement of the door panel 22, such as movement of the first surface 34 relative to the return panel 26, that corresponds to an increase in the gap at the interface 28 between the door panel 22 and the return panel 26. An increase in the gap may correspond to deflection of the first surface 34 or movement of the entire door panel 22 in a direction that corresponds to an increase in the gap at the interface 28. The increase will occur in some cases at only a localized portion of the interface 28. Depending on the object, the gap along the entire interface 28 may change.

Microswitches are used in one example because they have the ability to provide a significant electrical output responsive to a very minor change in position of a switch component. In other words, microswitches are used in one example because of the ability to detect very small changes in a gap between the door panel 22 and the return panel 26 at the interface 28.

The example door panels 22 also include a second switch 50. An activating switch arm 52 in this example, moves responsive to a deflection or movement of the first surface 34 corresponding to increased pressure on the first surface 34 compared to the amount of pressure applied to cause the movement for activating the switch 30. The switch 50 in this example provides a second level of object detection. Further movement of the first surface 34 in many circumstances will correspond to an object becoming caught at the interface 28 resulting in the increased pressure on and corresponding increased movement of the surface 34. The second switch 50 provides an output to the controller 40 indicative of this condition.

Figure 3:
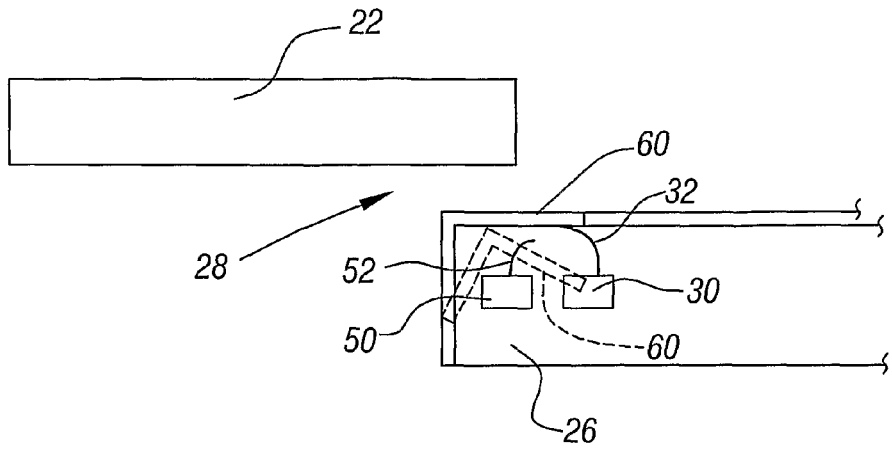
FIG. 3 schematically illustrates another example sensor placement.

FIGS. 1 and 2 show one example door arrangement. Another example is schematically shown in FIG. 3. In this arrangement, the first switch 30 and the second switch 50 are supported on the return panel 26. In this example, a portion 60 of the return panel 26 is flexible or moveable from a standard position responsive to an object approaching or getting caught in the interface 28 during automated door movement, for example. The illustrated example includes a portion 60 that is supported relative to a remainder of the return panel 26 so that the portion 60 can move between a rest position (shown in solid line) to a deflected position (shown in phantom in the drawing).

A first amount of movement or deflection of the portion 60 activates the switch 30 to provide an indication that an object is approaching the interface 28. The second switch 50 is configured to provide an indication when a further deflection occurs corresponding to an object becoming caught at the interface 28. As can be appreciated from the illustration, when the portion 60 moves from the position shown in solid lines to the position shown in phantom lines, the corresponding gap between the return panel 26 and the door panel 22 increases. The first switch 30 and the second switch 50 are supported and configured to provide respective indications of an initial amount of an increase in the gap and a further increase. The two switches provide corresponding outputs indicating conditions that are interpreted by the controller 40 as corresponding to an object being at the interface 28 or caught I the interface 28.

Figure 4:
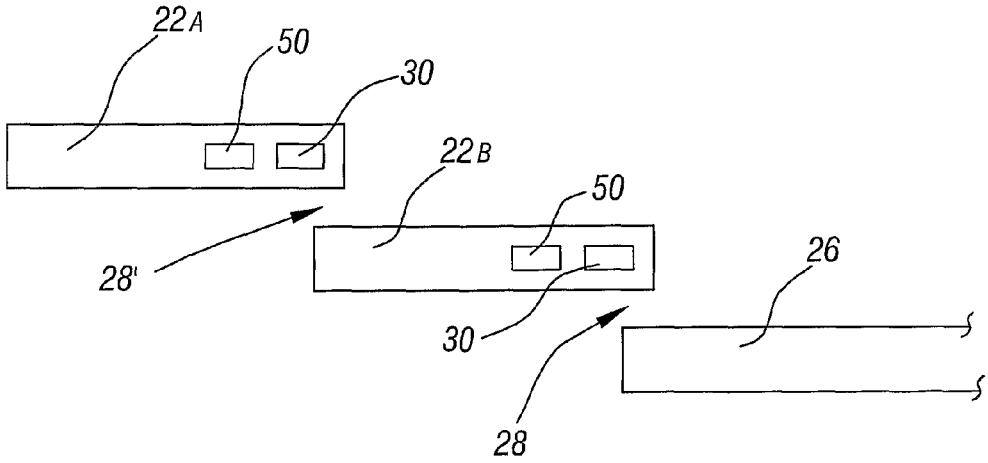
FIG. 4 schematically illustrates another example sensor placement.

FIG. 4 shows another example arrangement where first sensor 30 and a second sensor 50 are provided on door panels 22A and 22B. In this example, the door panel 22A is a so-called high speed door panel and the door panel 22B is a so-called low speed door panel. There is an interface 28 between the door panel 22B and the return panel 26. There is another interface 28' between the door panels 22A and 22B. During movements between open and closed positions there is relative movement between the door panels 22A and 22B and between the door panel 22B and the return panel 26. The first switches 30 and second switches 50 allow for detecting an increase in the gap at either interface 28 or 28' in the event that an object applies pressure against the corresponding door panel 22A or 22B.

Figure 5:
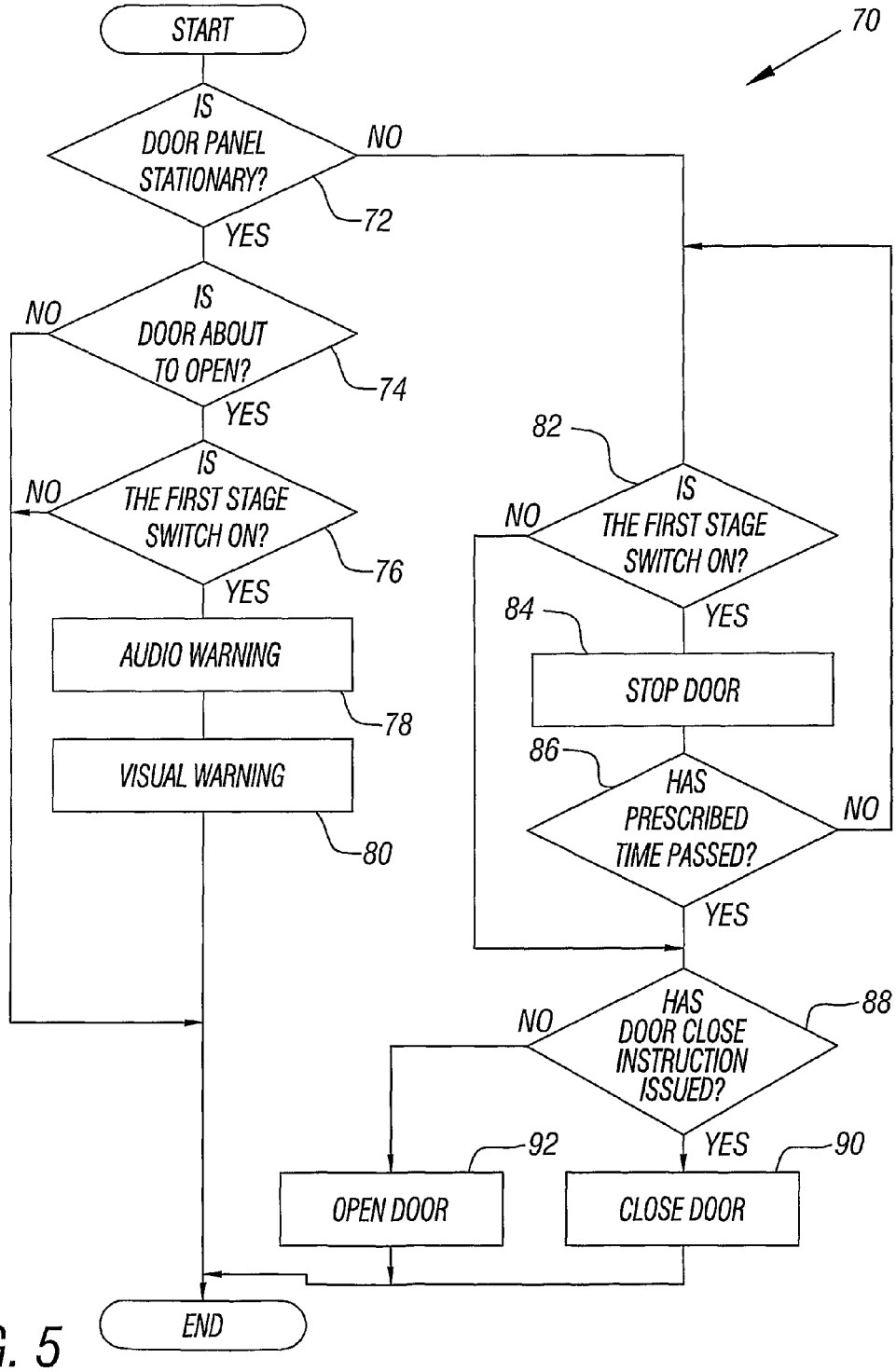
FIG. 5 is a flowchart diagram summarizing one example control strategy useful in an embodiment of this invention.

FIG. 5 includes a flow chart diagram 70 summarizing one example control approach for controlling automated movement of a door panel responsive to an indication from at least one of the switches 30, 50 regarding an object near or in the interface 28. A decision is made at 72 whether the door panel of interest is stationary. If so, a decision is made at 74 whether the door is about to open. If not, the example of FIG. 5 allows for overriding or ignoring an output from one of the switches 30 or 50 under conditions where there is no likelihood that an object is going to become caught at the interface 28 because the door is not moving or not about to move.

In the event that the door is about to move, a decision is made at 76 whether the first switch 30 has been activated. If so, the example of FIG. 5 includes issuing an audible warning at 78 and a visual warning at 80 to advise an individual that there is an object in a position relative to the door panel 22 where the object may get caught during door movement. Other examples include only a visual warning. Still other examples include using only an audible warning. In one example, after the appropriate warning has been provided, a selected amount of time is allowed to elapse before commencing door movement.

In the example of FIG. 5, when the door panel is moving (e.g., a negative result at the decision 72), a decision is made whether at least the first switch 30 has been activated at 82. If so, the door stops at 84 and a timer begins to allow a predetermined amount of time to pass. A decision at 86 is made whether that time has passed. If not, the example of FIG. 5 includes continuing to monitor whether the switch is still activated indicating that an object is still in a position where it may be or is caught at the interface 28. Once the appropriate amount of time has passed or the switch is no longer activated, a decision is made at 88 whether a door close instruction has issued. If so, the door is closed at 90. If not, the door continues opening at 92.

Figure 6:
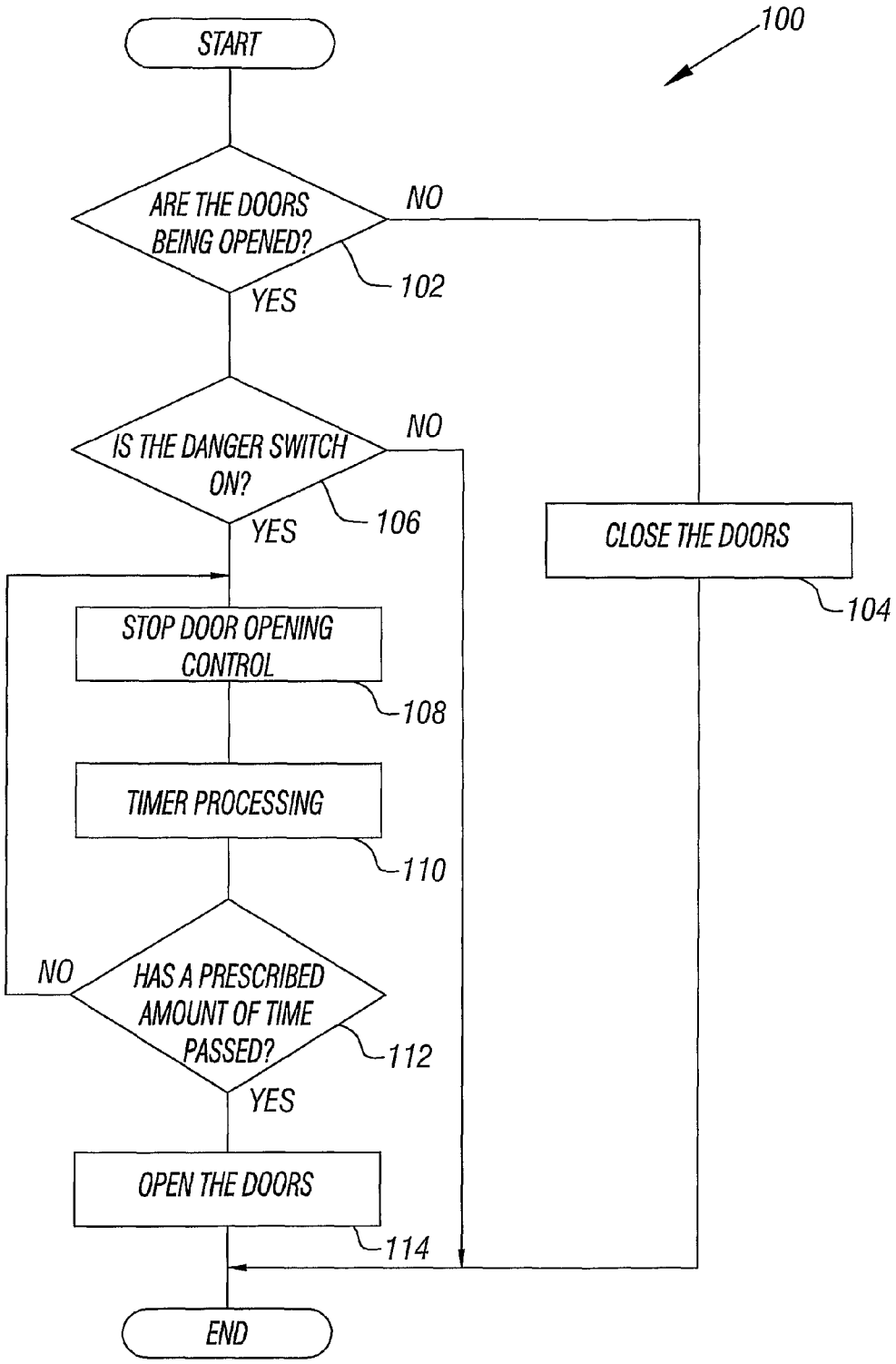
FIG. 6 is a flowchart diagram summarizing another example control strategy.

FIG. 6 includes a flow chart diagram 100 illustrating one example approach for responding to an indication from the first switch 30 regarding the presence of an object in a position where it may become caught at the interface 28. In other words, the flow chart diagram 100 in the example of FIG. 6 summarizes one example approach for responding to an increase in the gap at the interface 28 that is small enough to only activate the first switch 30. In this example, a decision is made at 102 whether the door is being opened. If not, a command is issued at 104 to ensure that the doors are fully closed. If the doors are being opened, a determination is made at 106 whether the first switch 30 has been activated. If so, the door stops moving at 108. A timer begins running at 110 to allow for a predetermined amount of time to lapse before the door is allowed to move again. At 112, a decision is made whether that time has passed. Until it has, the door remains stationary. After the time has passed, the door continues opening at 114. During the time between stopping the door and opening the door, it is possible to provide at least one of an audible or visual warning to move an object away from the door panel 22 to reduce the risk of being caught at the interface 28.

Figure 7:
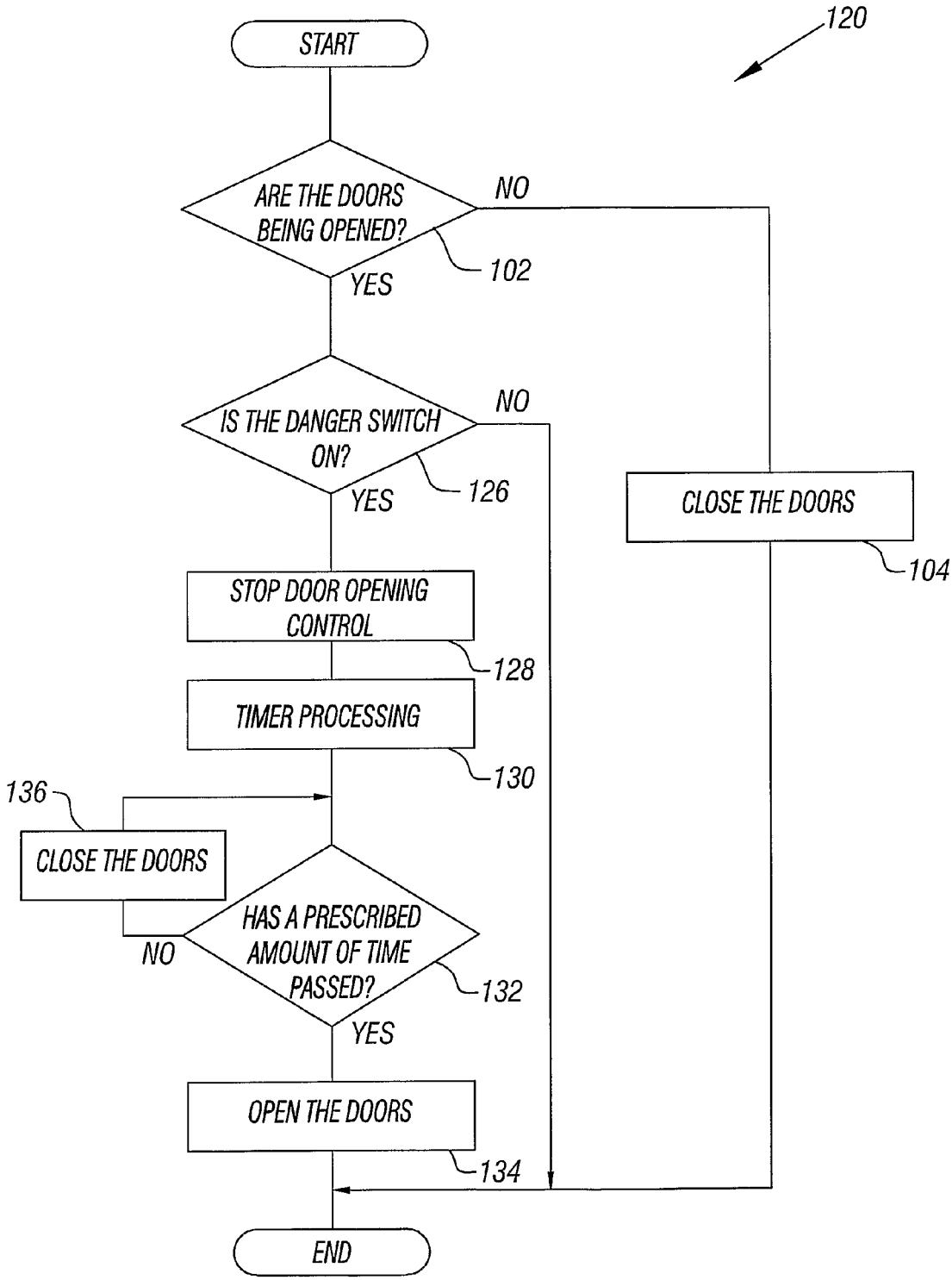
FIG. 7 is a flowchart diagram summarizing another example control strategy.

In some circumstances, enough pressure is applied on the door panel 22 to increase the gap between the door panel 22 and the return panel 26, for example, to activate the second switch 50. As mentioned above, the second switch 50 preferably is configured to be activated responsive to an amount of movement of the door panel 22 corresponding to an object being caught in the interface 28. The example of FIG. 7 includes a flowchart diagram 120 summarizing one approach for responding to an output from the second switch 50. In this example, if the door is not being opened a command to make sure the door is closed is issued at 104.

If the second switch 50 has been activated at 126, the door stops moving at 128. A timer begins at 130 to allow for a predetermined amount of time to pass before the door will continue moving in an opening direction. In this example, the determination regarding that amount of time is made at 132. If that amount of time has not passed, a command is issued at 136 to move the door in a closing direction for a short period of time to assist in removing any object that was caught at the interface 28. In this example, the determination at 132 includes determining whether the amount of time for moving the door in the closed direction has passed, also. Once that has passed, the door continues opening at 134.

In one example, continued movement of the door in the opening direction is carried out at a lower speed and with less torque than would have been done if no indication was provided from either the first switch 30 or the second switch 50. In other words, one aspect of the example technique for controlling automatic door movement includes reducing the speed and torque used for opening a door responsive to activation of at least one of the switches to provide additional protection to the object involved. Using lower speed and lower torque also facilitates allowing for an object to be removed from the interface 28 in the event that it became caught but could not be freed during the reversed movement of the door in the closing direction for the short period of time.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A door assembly, comprising a door panel that is automatically moveable between open and closed positions;

at least one switch that is activated responsive to an increase in a gap at an interface between the door panel and another surface that the door panel moves past while the door panel moves between the open and closed positions, the increase resulting in a first size of the gap;

at least one second switch that is activated responsive to a second increase in the gap, the second increase resulting in a second, larger size of the gap; and a controller that controls automatic movement of the door panel in a first mode responsive to activation of the at least one switch and in a second, different mode responsive to activation of the at least one second switch.

2. The assembly of claim 1, wherein the at least one switch is supported on the door panel and is activated responsive to movement of the door panel away from the surface in a direction generally perpendicular to a direction of movement of the door panel between the open and closed positions.

3. The assembly of claim 2, wherein the at least one switch is activated responsive to movement of the door panel corresponding to an object approaching the interface such that the object may become caught between the door panel and the surface; and the at least one second switch is activated responsive to movement of the door panel corresponding to the object being caught between the door panel and the surface.

4. The assembly of claim 1, wherein the first mode includes at least temporarily preventing movement of the door panel and providing an indication that an object should be moved away from the door panel or the interface; and the second mode includes at least temporarily stopping movement of the door panel and subsequently automatically moving the door panel after at least a predetermined amount of time elapses after the stopping.

5. The assembly of claim 4, wherein the second mode comprises moving the door panel in a first direction and then in a second, opposite direction after the predetermined amount of time elapses.

6. The assembly of claim 1, wherein the at least one switch and the at least one second switch are supported on a door to indicate movement of one surface on the door toward another surface on the door.

7. The assembly of claim 1, wherein the at least one switch is supported on the surface such that the switch is activated by a moveable portion of the surface that moves responsive to an object approaching the interface.

8. The assembly of claim 7, wherein the surface comprises a return panel associated with a door frame near the door panel.

9. The assembly of claim 7, wherein the surface comprises another door panel.

10. The assembly of claim 1, wherein the door panel is an elevator door panel.

11. The assembly of claim 1, wherein the first increase in the gap is an initial increase in the gap and the second increase in the gap is a subsequent, further increase in the gap.

* * * * *